US005474382A

United States Patent [19]

May

[11] Patent Number: 5,474,382

[45] Date of Patent: Dec. 12, 1995

[54] CLOSURE ARRANGEMENT HAVING A PEELABLE SEAL

[75] Inventor: Timothy J. May, Greenville, Wis.

[73] Assignee: Reynolds Consumer Products Inc., Appleton, Wis.

[21] Appl. No.: 432,502

[22] Filed: May 1, 1995

[51] Int. Cl.[6] ..... B65D 33/18; B65D 33/25

[52] U.S. Cl. ..... 383/211; 383/63

[58] Field of Search ..... 383/5, 63, 210, 383/211

[56] References Cited

U.S. PATENT DOCUMENTS

| | | | |
|---|---|---|---|
| 3,339,606 | 9/1967 | Kugler | 383/63 |
| 4,791,710 | 12/1988 | Nocek et al. | 383/63 X |
| 4,923,701 | 5/1990 | Van Erden | 383/63 X |
| 4,947,525 | 8/1990 | Van Erden | 383/63 X |
| 5,002,781 | 3/1991 | Van Erden | 383/63 X |
| 5,017,021 | 5/1991 | Simonsen et al. | 383/63 |

*Primary Examiner*—Allan N. Shoap
*Assistant Examiner*—Jes F. Pascua
*Attorney, Agent, or Firm*—Alan T. McDonald

[57] ABSTRACT

A closure arrangement for a polymeric bag comprises first and second opposing base panels and first and second closure profiles extending inwardly toward an interior of the bag from the respective first and second base panels. The first closure profile includes a first locking member, and the second closure profile includes a second locking member releasably engageable with the first locking member. The second closure profile further includes a post laterally spaced from the second locking member by a lateral distance sufficient to receive the first locking member between the second locking member and the post while providing a gap between the first locking member and the post. A peelable strip is disposed in the gap to create a peelable seal between the first locking member and the post.

13 Claims, 1 Drawing Sheet

CLOSURE ARRANGEMENT HAVING A PEELABLE SEAL

FIELD OF THE INVENTION

The present invention generally relates to closure arrangements for polymeric (plastic) bags and, more particularly, relates to a closure arrangement having a peelable seal which provides a consistent hermetic seal from one bag to the next and which is economical compared to other types of peelable seals.

DESCRIPTION OF THE PRIOR ART

In many consumer packaging applications, it is important to prevent air or water or the like from passing out of or into a package containing certain products. This is particularly true with respect to meat packages, cheese packages, and the like, for which the contained product must be kept in a constant environment to prevent spoilage. In order to preserve the product contained within such a package, the periphery of the package must be hermetically sealed. Hermetic seals can be provided by both permanent seals and temporary seals known as peelable seals. Peelable seals are capable of providing a hermetic seal and, at the same time, providing a consumer with access to the contents of a package. A peelable seal is a one-time seal which is broken by a consumer to initially gain access to the contents of the package. Once the peelable seal is broken, it cannot be restored.

To provide a peelable seal on a package with a reclosable zipper, the package typically uses permanent seals at its side edges and bottom edge and a peelable seal at the mouth end of the bag. Heretofore, the peelable seal at the mouth end of the bag has been positioned either adjacent to the reclosable zipper at the mouth end of the package or in gaps between male and female locking members of the reclosable zipper.

When arranged adjacent to the reclosable zipper, the peelable seal is often positioned either above or below the reclosable zipper on the flange/skirt thereof. Positioning the peelable seal on the skirt of the zipper is disadvantageous because the skirt must be wide enough to accommodate the peelable seal. Such a wide skirt increases the amount of polymeric material required to form the zipper and, therefore, increases the cost of producing the zipper. Moreover, positioning the peelable seal on the skirt of the zipper does not lend itself to consistent, reliable, and economical production under a common manufacturing technique employed today. In this common manufacturing technique, two companies contribute to the production of bags with reclosable zippers. A zipper manufacturer produces zippers having peelable material on the skirts thereof. The zipper manufacturer typically does not activate peelable seals from the peelable material. Rather, the zipper manufacturer supplies the zippers to a bag manufacturer which applies the zippers to their bags and heats the peelable material to generate peelable seals. A drawback of the foregoing manufacturing technique is that to generate the peelable seals from the peelable material, the bag manufacturer often must modify their heat sealing equipment to provide additional heat seal bars aimed at the area of the peelable material. Such modification of equipment can be costly. In addition, since the zipper manufacturer applies the peelable material to the zipper skirts while the bag manufacturer heats the peelable material to generate the peelable seals, it is difficult for the bag manufacturer to insure uniformity of pealable seal strength from one bag to the next and to adequately control the strength of the peelable seals.

In an effort to overcome the above-noted shortcomings associated with positioning the peelable seal on the skirt of the zipper, it has been taught to arrange the peelable seal in gaps between male and female locking members of the reclosable zipper. When arranged in gaps between male and female locking members of the reclosable zipper, the peelable seal is positioned as shown, for example, in U.S. Pat. No. 5,002,781. In U.S. Pat. No. 5,002,781, the peelable seal is located between a T-shaped head of a male locking member and a base of a groove formed by two female locking members. A disadvantage of such a peelable seal is that it allows contaminants to travel up to the point of the peelable seal, which means that the locking members themselves can be contaminated prior to opening the bag.

Consequently, a need exists for a closure arrangement for a polymeric bag which overcomes the aforementioned shortcomings associated with existing peelable seals.

SUMMARY OF THE INVENTION

In one particular embodiment, the present invention provides a closure arrangement for a polymeric bag comprising first and second opposing base panels and first and second closure profiles extending inwardly toward an interior of the bag from the respective first and second base panels. The first closure profile includes a first locking member, and the second closure profile includes a second locking member releasably engageable with the first locking member. The second closure profile further includes a post laterally spaced from the second locking member by a lateral distance sufficient to receive the first locking member between the second locking member and the post while providing a gap between the first locking member and the post. A peelable strip is disposed in the gap to create a peelable seal between the first locking member and the post.

In an alternative embodiment, the first closure profile includes an additional post arranged relative to the post of the second closure profile such that engagement of the first and second locking members creates a space between the post of the first closure profile and the post of the second closure profile. The peelable strip is then disposed in this space to create a peelable seal between the two posts.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
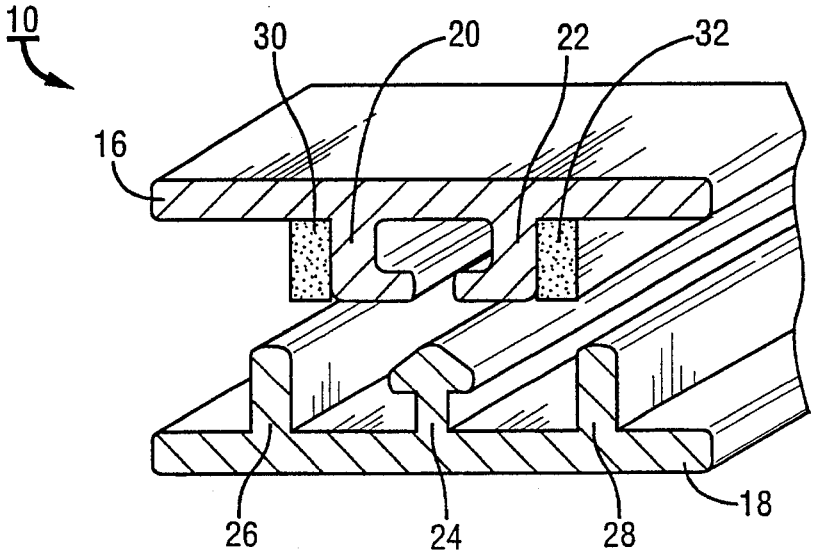
FIG. 1 is a fragmental isometric view of a closure arrangement embodying the present invention, prior to forming peelable seals.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 2:
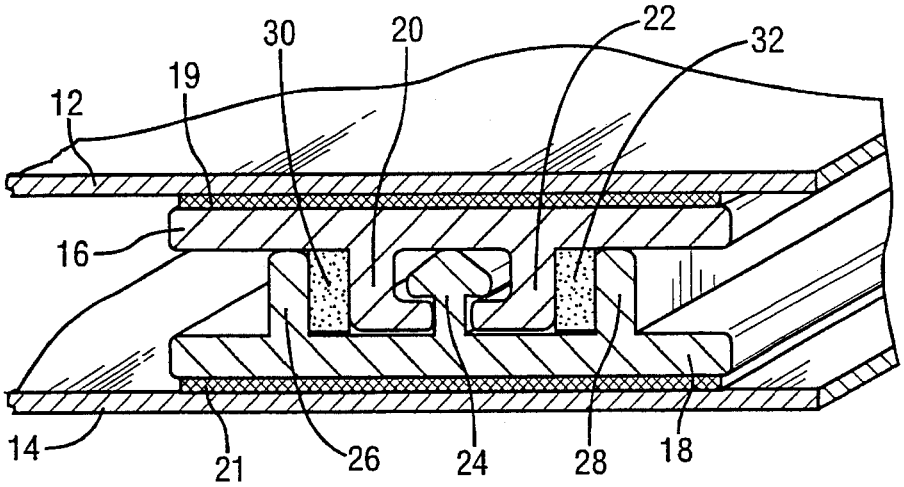
FIG. 2 is a fragmental isometric view of the closure arrangement in FIG. 1, showing the peelable seals after being formed.

Turning now to the drawings, FIGS. 1 and 2 illustrate fragmental isometric views of a closure arrangement 10. As shown in FIG. 2, .the closure arrangement 10 is disposed at the mouth of a reclosable bag having top and bottom films 12, 14 extends along the length of the bag mouth. For the sake of simplicity, FIG. 2 only depicts portions of the top and bottom films 12, 14 located at the mouth of the reclosable bag. The closure arrangement 10 preferably includes first and second opposing base strips 16, 18 and female and male closure profiles extending inwardly toward an interior of the bag from the respective first and second base strips 16, 18. The female and male closure profiles are integrally formed with the respective first and second base strips 16, 18.

To attach the closure arrangement 10 to the top and bottom films 12, 14 of the polymeric bag, the top film 12 may be attached to the outer surface of the base strip 16 by means of sealant material 19. Since the sealant material 19 bonds readily to other materials at low temperatures, the sealant strip acts as a bridge for attaching the top film 12 to the base strip 16. Likewise, the bottom film 14 may be attached to the outer surface of the base strip 18 by means of sealant material 21. Alternatively, the top and bottom films 12, 14 may be heat-fused directly to the outer surfaces of the respective base strips 16, 18 without the use of intervening sealant material.

The female closure profile includes a pair of flexible locking members 20, 22 with hooks at the ends thereof, and the male closure profile includes at least one flexible locking member 24 with an expanded head releasably engageable between the pair of locking members 20, 22. More specifically, the pair of locking members 20, 22 interlock with the locking member 24 in a snapping action caused by bringing the hooks of the pair of locking members 20, 22 past the expanded head of the locking member 24. To facilitate alignment of the pair of locking members 20, 22 with the locking member 24 during reclosure, the male closure profile is provided with a pair of generally straight posts 26, 28 laterally disposed on opposite sides of the locking member 24. These posts 26, 28 are laterally spaced from the locking member 24 by respective lateral distances sufficient (1) to receive the locking member 20 between the post 26 and the locking member 24 while providing a gap between the locking member 20 and the post 26 and (2) to receive the locking member 22 between the post 28 and the locking member 24 while providing a gap between the locking member 22 and the post 28 (see FIG. 2).

To form peelable seals, peelable strips 30, 32 are disposed in the gaps between the locking members 20, 22 and the respective posts 26, 28. In FIG. 2, the peelable strip 30, weakly, yet hermetically, links an inner surface of the base strip 16 and laterally outer side of the locking member 20 to an inner surface of the base strip 18 and laterally inner side of the post 26. Similarly, the peelable strip 32 links an inner surface of the base strip 16 and laterally outer side of the locking member 22 to an inner surface of the base strip 18 and laterally inner side of the post 28. Thus, the peelable strips 30, 32 create respective peelable seals.

Since the peelable seals are not applied to the skirt/flange portions of the base strips 16, 18 (i.e., rightmost and leftmost portions of the base strips 16, 18 as viewed in FIGS. 1 and 2), the skirt/flange portions can be made narrower in the horizontal dimension as viewed in FIGS. 1 and 2 than in zippers which employ peelable seals on the skirts thereof. This narrower skirt results in a material savings, thereby decreasing the cost of producing the closure arrangement 10. Another advantage of the peelable seals created by the peelable strips 30, 32 is that they prevent contamination of the locking members 20, 22, and 24 until the consumer initially opens the bag. The peelable seals isolate the locking members 20, 22, and 24 on both sides from contact with contaminants.

As shown in FIG. 2, prior to initially opening a bag incorporating the closure arrangement 10, the peelable seals are intact and the locking members 20, 22 of the female closure profile are interlocked with the locking member 24 of the male closure profile. To open the bag, the interlocked closure profiles are disengaged from each other by grabbing onto the top and bottom films 12, 14 and pulling them apart. While disengaging the closure profiles, the peelable strips 30, 32 in the gaps between the locking members 20, 22 and the respective posts 26, 28 are disconnected from the laterally inner sides of the respective posts 26, 28 and the respective adjacent portions of the inner surface of the base strip 18, thereby breaking the peelable seals. Alternatively, the closure arrangement 10 may be designed such that the bond attaching the peelable strips 30, 32 to both the respective posts 26, 28 and base strip 18 is stronger than the internal strength of the peelable strips 30, 32. In this case, disengaging the closure profiles causes the peelable strips 30, 32 to rupture so that portions of the peelable strips 30, 32 remain attached to the respective posts 26, 28 and the base strip 18 and the remaining portions of the peelable strips 30, 32 remain attached to the respective locking members 20, 22 and the base strip 16.

Although it is contemplated that the closure arrangement 10 may be designed with a single peelable strip, instead of the two peelable strips 30, 32, an advantage of providing the two peelable strips 30, 32 is that they create two separate peelable seals. Therefore, if one of the two peelable seals should accidently fail, the other of the two peelable seals is still intact to protect the contents of the reclosable bag.

The peelable seals in FIG. 2 may be formed using a couple different manufacturing techniques. In one manufacturing technique, the peelable strips 30, 32, the base strips 16, 18, the female closure profile, and the male closure profile are coextruded with each other through a die plate fed by a plurality of extruders. These extruders carry the different molten materials for forming the peelable strips 30, 32, the base strips 16, 18, the female closure profile, and the male closure profile. As is well known in the art, the die plate includes input ports, output ports, and channels connecting these input ports to output ports. The extruders feed the different molten materials to different input ports, and the channels are designed to configure the molten materials into the shapes of the various elements of the closure arrangement 10. The output ports are arranged such that the peelable strips 30, 32, the base strip 16, and the female closure profile exit the die plate with the peelable strips 30, 32 attached to the laterally outer sides of the respective locking members 20, 22 and to the respective adjacent portions of the inner surface of the base strip 16. The base strip 18 and the male closure profile exit the die plate separated from the peelable strips 30, 32, the base strip 16, and the female closure profile (see FIG. 1).

After coextruding the peelable strips 30, 32, the base strips 16, 18, the female closure profile, and the male closure profile, heat is applied to the peelable strips 30, 32 to soften these strips prior to mating the female and male closure profiles. While the peelable strips 30, 32 are still soft due to the applied heat, the locking members 20, 22 are engaged with the locking member 24. Engaging the locking members 20, 22 with the locking member 24 attaches the softened peelable strips 30, 32 to the laterally inner sides of the posts 26, 28 and the respective adjacent portions of the inner surface of the base strip 18, thereby creating the peelable seals (see FIG. 2).

In an alternative manufacturing technique, the base strips 16, 18, the female closure profile and the male closure profile are initially coextruded with each other without the peelable strips 30, 32. Then, in a separate extrusion process, a pair of extruders apply the respective peelable strips 30, 32 to the laterally outer sides of the respective locking members 20, 22 and adjacent portions of the inner surface of the base strip 16. While the peelable strips 30, 32 are still soft from this separate extrusion process, the female and male closure profiles are mated with each other to create the peelable seals.

Each of the foregoing manufacturing techniques is preferably performed by a zipper manufacturer. After the zipper manufacturer produces the closure arrangement 10, the closure arrangement 10 is supplied to a bag manufacturer which applies the closure arrangement 10 to their bags as shown in FIG. 2. As described previously, the top film 12 is attached directly or by means of the sealant material 19 to the outer surface of the base strip 16. Similarly, the bottom film 14 is attached to the other surface of the base strip 18.

Since the zipper manufacturer creates the peelable seals, the bag manufacturer need not modify their heat sealing equipment to apply the closure arrangement 10 to their bags. Moreover, since the process of creating the peelable seals is not divided among two companies, but rather is performed entirely by the zipper manufacturer, the zipper manufacturer can insure uniformity of peelable seal strength from one bag to the next and can adequately control the strength of the peelable seals. In a preferred embodiment, the peelable seals have a combined strength ranging from two to seven pounds per lineal inch as measured along the length of the peelable seals. It has been found that a seal strength within this range allows the peelable seals to hermetically seal the associated bag and, at the same time, allows the peelable seals to be quickly and easily broken.

The peelable material used to form the peelable strips 30, 32 is preferably a mixture of three components. First, the peelable material includes an ethylene vinyl acetate (EVA) copolymer such as Product No. AT 3325M EVA manufactured by AT Plastics, Inc. of Edmonton, Alberta, Canada or ULTRATHENE® UE654.67 from Quantum Chemical Co., USI Division, Cincinnati, Ohio. Second, the peelable material includes a polyethylenebased wax such as C-15 EPOLENE® wax manufactured by Eastman Chemical Company of Longview, Tex. Third, the peelable material includes a polypropylene such as ESCORENE® manufactured by Exxon Chemical Company of Baytown, Tex. Polypropylene is widely available from many other commercial sources. The weight percentages of the foregoing three components of the peelable material preferably are about 50% EVA copolymer, about 25% polyethylene-based wax, and about 25% polypropylene.

The material used to form the base strips 16, 18 and the female and male closure profiles is preferably composed of a mixture of two components. First, the material includes a low density polyethylene such as Product No. 412FA manufactured by Westlake Polymers Corporation of Lake Charles, La. Second, the material includes an EVA copolymer such as product N-722.62 manufactured by Exxon Chemical Company. The preferred weight percentages are about 90% low density polyethylene and about 10% EVA copolymer.

While the present invention has been described with reference to one or more particular embodiments, those skilled in the art will recognize that many changes may be made thereto without departing from the spirit and scope of the present invention.

Figure 3:
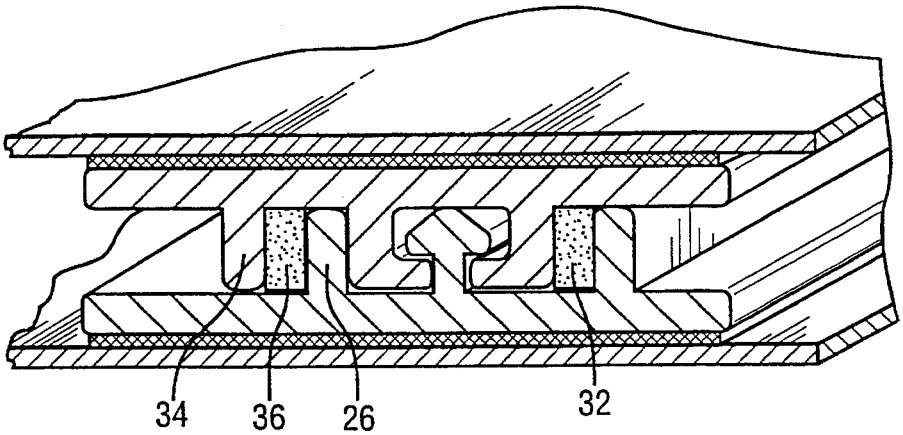
FIG. 3 is a fragmental isometric view of a modified closure arrangement embodying the present invention, showing the peelable seals after being formed.

For example, the closure arrangement 10 may be modified to remove one of the peelable strips 30, 32. In another alternative embodiment, the closure arrangement 10 is modified to provide the female closure profile with one or more additional posts, such as the post 34 in FIG. 3. As shown in FIG. 3, a peelable strip 36 is then positioned in a gap between the post 34 and the post 26 to create a peelable seal. This peelable strip 36 may be used in place of or in addition to one or both of the peelable strips 30, 32 of FIG. 2. In FIG. 3, for instance, the peelable strip 36 is used in place of the peelable strip 30 of FIG. 2 and in combination with the peelable strip 32. Each of these embodiments and obvious variations thereof is contemplated as falling within the spirit and scope of the invention, which is set forth in the following claims.

What is claimed is:

1. A closure arrangement for a polymeric bag, comprising:

first and second opposing base panels;

first and second closure profiles extending inwardly toward an interior of the bag from the respective first and second base panels, the first closure profile including a first locking member having engageable surfaces and the second closure profile including a second locking member having engageable surfaces releasably engageable with the first locking member, the second closure profile further including a generally straight post free of a locking hook at the end thereof, the post being laterally spaced from the second locking member by a lateral distance sufficient to receive the first locking member between the second locking member and the post while providing a gap between the first locking member and the post; and a peelable strip of a peal-seal material disposed in the gap between the first locking member and the post to create a peelable seal between the first locking member and the post, the engageable surfaces of the first and second closure profiles being free from peal-seal material.

2. The closure arrangement of claim 1, wherein the first and second base panels are configured as respective base strips adapted for attachment to respective opposing films of the bag.

3. The closure arrangement of claim 1, wherein the peelable strip attaches a laterally outer side of the first locking member to a laterally inner side of the post.

4. The closure arrangement of claim 3, wherein the peelable strip further attaches a portion of the inner surface of the first base panel to a portion of the inner surface of the second base panel.

5. The closure arrangement of claim 1, wherein disengagement of the first and second locking members irreversibly breaks the peelable seal.

6. A closure arrangement for a polymeric bag, comprising:

first and second opposing base panels;

female and male closure profiles extending inwardly toward an interior of the bag from the respective first and second base panels, the female closure profile including a pair of locking members having engageable surfaces and the male closure profile including a third locking member having an engageable surface releasably engageable between the pair of locking members, the male closure profile further including a generally straight first post free of a locking hook at the end thereof, the first post being laterally spaced from the third locking member by a lateral distance sufficient to receive one of the pair of locking members between the third locking member and the first post while providing a gap between the one of the pair of locking members and the first post; and a first peelable strip of peal-seal material disposed in the gap between the one of the pair of locking members and the first post to create a peelable seal between the one of the pair of locking members and the first post, the engageable surfaces of the first and second closure profiles being free from peal-seal material.

7. The closure arrangement of claim 6, wherein the male closure profile includes a generally straight second post free of a locking hook at the end thereof, the first and second posts being disposed on opposite sides of the third locking member.

8. The closure arrangement of claim 7, wherein the second post is laterally spaced from the third locking member by a lateral distance sufficient to receive the other of the pair of locking members between the third locking member and the second post while providing a space between the other of the pair of locking members and the second post, and further including a second peelable strip disposed in the space between the other of the pair of locking members and the second post to create a second peelable seal between the other of the pair of locking members and the second post.

9. The closure arrangement of claim 6, wherein the first and second base panels are configured as respective base strips adapted for attachment to respective opposing films of the bag.

10. A closure arrangement for a polymeric bag, comprising:

first and second opposing base panels;

first and second closure profiles extending inwardly toward an interior of the bag from the respective first and second base panels, the first closure profile including a first locking member having an engageable surface and the second closure profile including a second locking member having an engageable surface releasably engageable with the first locking member, the first closure profile further including a generally straight first post free of a locking hook at the end thereof, the second closure profile further including a generally straight second post free of a locking hook at the end thereof, the first and second posts being laterally spaced from each other to create a gap therebetween; and a peelable strip of a peal-seal material disposed in the gap between the first and second posts to create a peelable seal between the first and second posts, the engageable surfaces of the first and second closure profiles being free from peal-seal material.

11. The closure arrangement of claim 10, wherein the peelable strip attaches a laterally outer side of the first post to a laterally inner side of the second post.

12. The closure arrangement of claim 11, wherein the peelable strip further attaches a portion of the inner surface of the first base panel to a portion of the inner surface of the second base panel.

13. The closure arrangement of claim 10, wherein disengagement of the first and second locking members irreversibly breaks the peelable seal.

* * * * *